US005904259A

United States Patent [19]

Hidding et al.

[11] Patent Number: 5,904,259

[45] Date of Patent: May 18, 1999

[54] PROTECTIVE TAMPER-EVIDENT LABEL AND BOTTLE CAP

[76] Inventors: Walter E. Hidding, Rte. 7-367A Woodrock Rd., Barrington Hills, Ill. 60010; Douglas J. Hidding, 801 E. Lake Shore Dr.—Tower Lakes, Barrington, Ill. 60010

[21] Appl. No.: 08/675,107

[22] Filed: Jul. 3, 1996

[51] Int. Cl.[6] ..... B65D 39/00

[52] U.S. Cl. ..... 215/232; 215/230; 215/256; 215/265; 220/254; 220/359.4

[58] Field of Search ..... 215/232, 230, 215/256, 265; 220/254, 359, 359.2, 359.4

[56] References Cited

U.S. PATENT DOCUMENTS

| | | | |
|---|---|---|---|
| 4,991,635 | 2/1991 | Ulm | 141/346 |
| 5,069,355 | 12/1991 | Matuszak | 220/359 X |
| 5,246,134 | 9/1993 | Roth et al. | 220/359 |
| 5,295,519 | 3/1994 | Baker et al. | 141/18 |
| 5,332,113 | 7/1994 | Kusler, III et al. | 215/249 |
| 5,353,943 | 10/1994 | Hayward | 220/276 |
| 5,370,270 | 12/1994 | Adams et al. | 215/254 X |
| 5,392,939 | 2/1995 | Hidding et al. | 215/265 |
| 5,395,005 | 3/1995 | Yoshida | 220/359 |
| 5,654,022 | 8/1997 | Sayre | 215/251 |

FOREIGN PATENT DOCUMENTS

| | | | |
|---|---|---|---|
| 2314828 | 1/1996 | United Kingdom | 215/232 X |

*Primary Examiner*—Stephen K. Cronin
*Attorney, Agent, or Firm*—Baker & McKenzie

[57] ABSTRACT

An improved, tamper-evident label and bottle cap to be used with standard five gallon bottles; such bottle cap of the type having a central tube section capable of receiving a dispensing probe which is part of a dispensing system. A micro-thin, plastic label is heat-sealed to the face of the bottle cap, thereby protecting the central tube section from any external contaminants. An edge of the label is left unsealed to provide a means for peeling the label from the bottle cap when the bottle is to be installed. By virtue of the heat-sealing method of attachment, the tamper-evident label cannot be reattached to the face of the bottle cap, or any other surface, once it is removed.

15 Claims, 6 Drawing Sheets

PROTECTIVE TAMPER-EVIDENT LABEL AND BOTTLE CAP

The present invention relates generally to plastic bottle caps of the type used for large bottles of liquid, such as drinking water, edible oils and liquid chemical substances, more specifically, to the variety of tamper-evident closures which are applied thereon.

BACKGROUND OF THE INVENTION

It is commonly known and practiced within this field of art that detachable, plastic bottle caps be mounted on the neck of standard five gallon bottles. Such bottle caps seal the bottle and the contents inside prior to the bottle's installation in a dispensing system. Normally, through the use of an attached pull tab and scoreline, the bottle cap is removed from its associated bottle prior to the bottle's installation and use. Examples of such caps are shown in the following U.S. Pat. Nos. 5,392,939; 5,370,270; 5,295,518; 4,991,635 and 4,699,188.

Recent developments in the bottle cap industry include a cap which has a central tube section which is capable of receiving a specialized dispensing probe from a dispensing system. This tube section has an inner seal which prevents the liquid from escaping the bottle until such dispensing probe is inserted. With this type of arrangement, the bottle cap itself need not be removed prior to its installation into a dispensing system.

While these newer types of bottle caps do, indeed, have liquid-tight seals, the surface areas of the bottle cap face and central tube section remain susceptible to external contaminants. Some manufacturers have addressed this concern by simply placing an adhesive-backed label upon the face of the bottle cap. This attempt to prevent contamination has at least one major drawback in that the labels, once removed, can again be reattached to the face of the bottle cap. If this is done carefully, there is no evidence that the label has been tampered with.

Alternatively, users of these systems have found it convenient to simply slap these labels on the side of the bottle rather than disposing of them in a waste container. This has two disadvantages. First, its is unsightly for such litter in the form of a used label to appear on the bottle when it is inverted on to a dispenser. Second, bottlers are forced to perform the step of removing the label from the side of the bottle before reusing the bottle. The adhesives used on such labels made this task quite difficult and costly.

Another problem which sometimes arises with valved or otherwise openable bottle caps is that they occasionally, although rarely, leak. Five gallon bottles are usually shipped in the horizontal position, which puts substantial hydraulic pressure on the cap and the particular seal associated therewith. Leaks may occur because of a small defect in the seal between components of the cap, or because of assembly problems. Pressure sensitive labels currently used in the industry over the top of valved or otherwise openable caps are not effective to provide even a secondary liquid-tight seal.

In light of the safety deficiencies and additional burdens associated with the protective labels which currently exist, what is still needed in this field of art is a tamper-evident label which can be easily and inexpensively attached to a standard bottle cap, which provides a liquid-tight seal and which cannot be reattached to the cap, or any other surface, once it is removed.

SUMMARY OF THE INVENTION

Accordingly, the thin tamper-evident label of the present invention is heat-sealed to the face of the associated bottle cap. This method of attachment provides a protective seal to those internal parts of the bottle cap which ultimately come into contact with liquid contained within the bottle. In addition, this tamper-evident label is free of adhesive and thus cannot be reattached to the bottle cap, or any other surface, once it is removed.

The tamper-evident label is made from a plastic-based material and is substantially the same size and shape as the flat upper face of the bottle cap. In one embodiment of the present invention, all but a very narrow peripheral edge of the tamper-evident label is heat-sealed to this cap face. The unattached peripheral edge serves as a grasping point by which a user may remove the label prior to the bottle's actual use. In a second embodiment, the entire label is heat-sealed to the cap face except for a single point along the peripheral edge which protrudes out over a "notched" edge of the bottle cap and which may be grasped by a user for label removal purposes. In a third embodiment, a raised portion, in the form of a circumferential bead, on the upper surface of the cap deflects a portion of the label upward to facilitate its being grasped and removed. The attachment of the label to the cap creates a seal which can withstand the pressure which may be exerted on the label if the valve or seal of a valved or openable cap leaks.

Should the label ever be tampered with, intentionally or not, its unsealed condition upon the face of the bottle cap would clearly be exhibited because there is no adhesive present to hold the label down in its original sealed position. Furthermore, the process of heat sealing often imparts a "curl" to the label once it is detached, making it difficult to properly re-align the label.

It is therefore a general object of the present invention to provide an inexpensive means of protecting those areas of a bottle cap which, when installed in a dispensing system, come into contact with the liquid contained within the container.

In addition, it is an object of the present invention to provide a tamper-evident label that cannot be reattached to its original place on a bottle cap once it is removed.

Another object of the present invention is to provide a tamper-evident label which cannot be re-attached to the side of a bottle or any other surface once it is removed.

Moreover, an additional object of the present invention is to offer a tamper-evident label which is very secure once it is in place, but which can still be easily removed.

An additional object of the present invention is to provide a cap with a tamper-evident label in which the edge of the label is easily grasped for purposes of removal of the label.

A further object of the present invention is to provide a cap in which the label provides a back-up seal for preventing escape of liquid from a bottle through the primary seal of a cap.

A further object of the present invention is to provide a label for a cap which has at least four functions; 1) information regarding the supplier of the liquid or the liquid itself, 2) protection for the valve of a valved cap and the surface adjacent to the valve, 3) evidence of tampering with, or misuse of, the associated bottle cap, and 4) creation of a secondary or back-up seal in the unlikely event that a leak occurs beneath the label as a result of a seal assembly or other manufacturing problem.

Further objects and advantages of the invention will become apparent to those of ordinary skill in the pertinent art upon review of the following detailed description, accompanying drawing, and appended claims.

BRIEF DESCRIPTION OF THE DRAWING

For a more complete understanding of this invention, reference should now be made to the embodiment illustrated in greater detail in the accompanying drawing and described below. In the drawing.

Notice must be taken that the figures are not necessarily to scale and that the embodiments are sometimes illustrated by phantom lines and diagrammatic representations. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF SOME PREFERRED EMBODIMENTS

Figure 1:
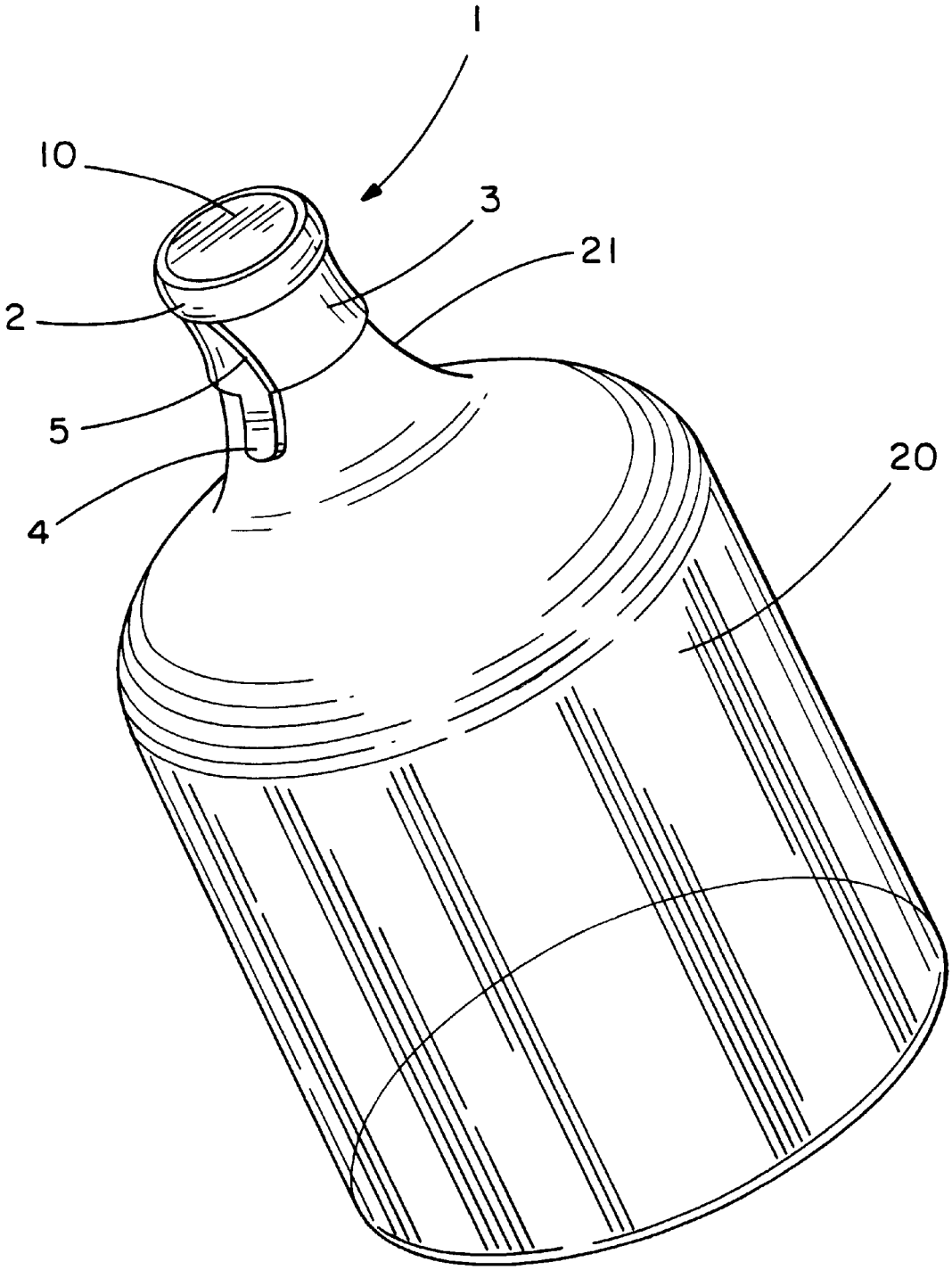
FIG. 1 is a perspective view of the tamper-evident label/bottle cap in its sealed position upon the neck of a standard five gallon bottle.

Turning first to FIG. 1, there is shown generally at 1 a perspective view of the bottle cap of the present invention. This bottle cap 1 is displayed in its sealed position upon the neck 21 of a standard five gallon bottle 20.

The openable bottle cap 1 of one preferred embodiment includes a snap-on ring section 2, a skirt 3, a pull tab 4 and a scoreline 5. Normal application of the bottle cap 1 requires that the snap on ring section 2 and skirt 3 be securely affixed to the neck 21 of the bottle 20. A pull tab 4 extends from the bottom edge of the skirt 3, as does the scoreline 5 which is used to open the skirt 3 and allows the snap on ring section 2 to be lifted off of the neck 21.

Figure 2:
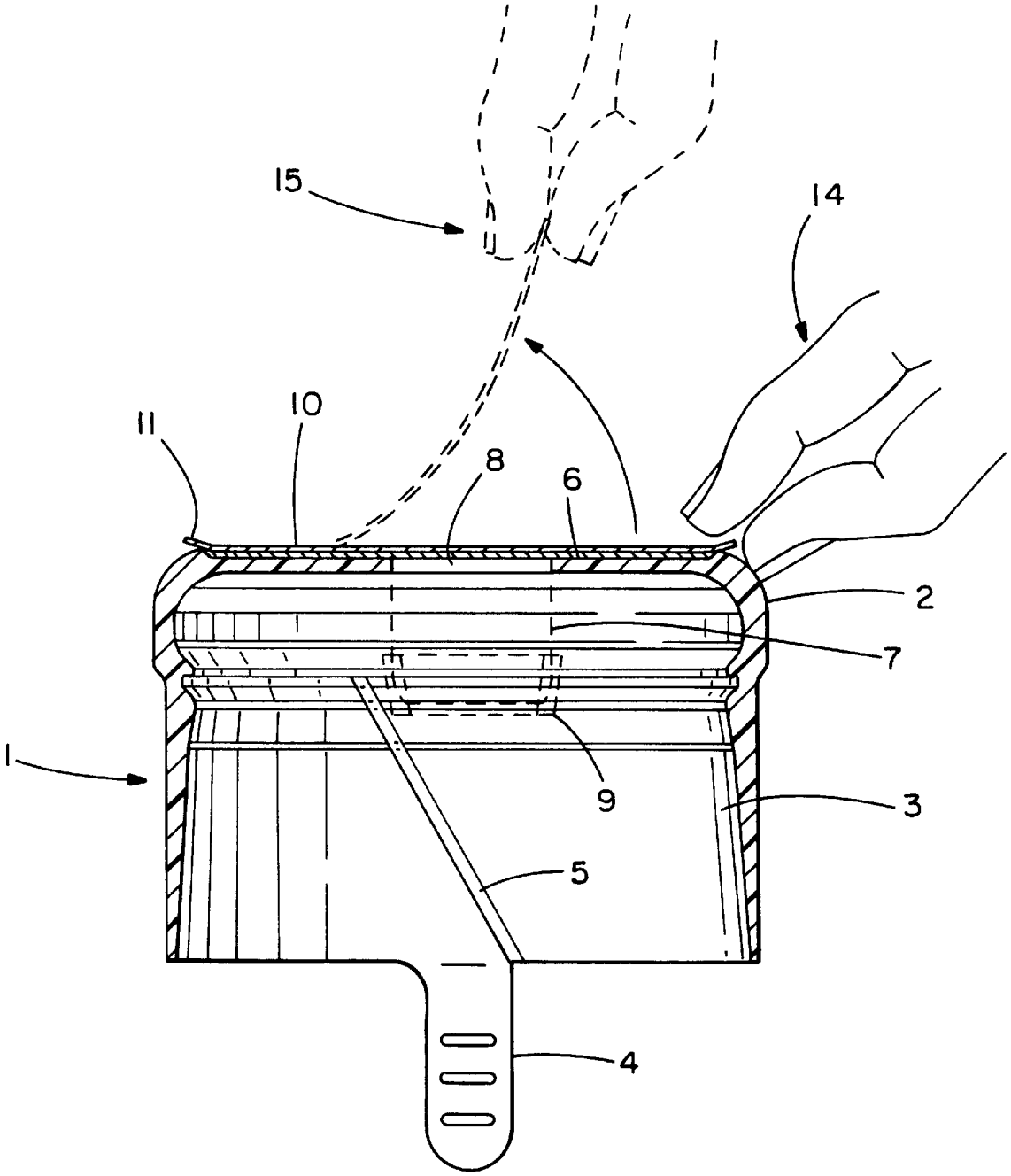
FIG. 2 is a side, cross-sectional view of a first embodiment of the present invention providing a developmental view of the tamper-evident label in both its sealed and unsealed states.
Figure 3:
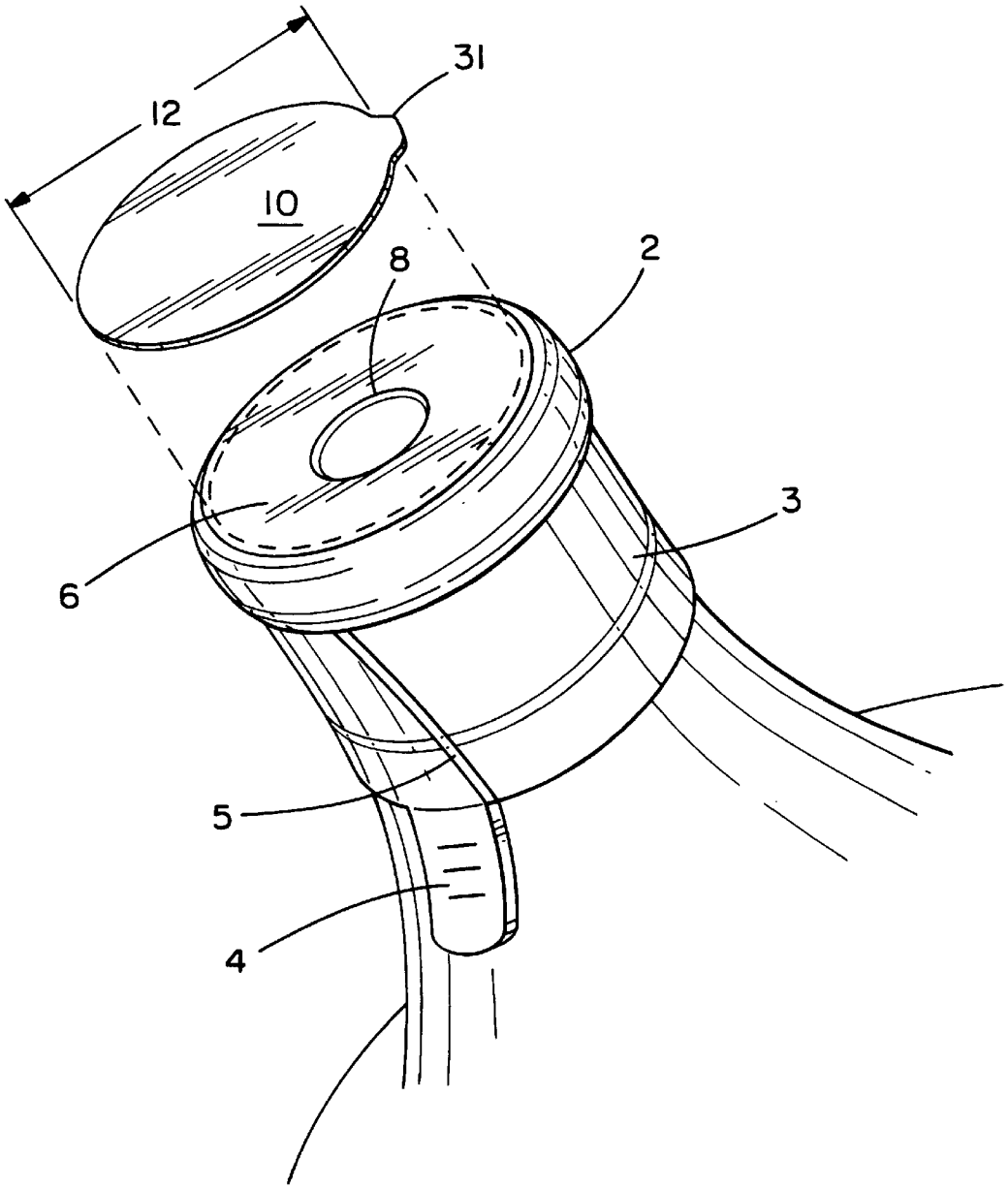
FIG. 3 is a top elevational view of the first embodiment of the present invention showing the approximate placement of the tamper-evident label upon the face of the bottle cap.

In keeping with the principle object of the invention, FIGS. 1–3 also show the tamper-evident label 10 placed upon the upper face 6 of the bottle cap 1. In its sealed position, the tamper-evident label 10 protects a dispensing outlet 8 of the bottle cap 1 from contaminants. To facilitate removal of the label 10, a lift tab 31 is formed on the periphery of the label 10.

Referring now to FIG. 2, a cross-sectional view of the first embodiment of the bottle cap 1 is illustrated. This figure shows not only the pull tab 4 and the scoreline 5, but also the structural outline of both the snap-on ring section 2 and the skirt 3. The bottle cap 1 of the present invention also has a relatively planar upper face 6. Formed integrally within this upper face 6 is the central dispensing tube 7. The central dispensing tube 7 has an opening or outlet 8 through which the liquid may be dispensed. For the purpose of sealing the bottle cap 1 and, more specifically, the central dispensing tube 7 to prevent liquid from being discharged before installation, a dispensing tube cap 9 is attached to the innermost end of the central dispensing tube 7. The operation and structure of the tube cap 9 can be more thoroughly understood from a reading of U.S. Pat. No. 5,392,939, which is incorporated herein by reference.

The bottle cap 1 is of the type in which the central tube 7 is capable of sealingly engaging a dispensing probe which is part of a dispensing system. The dispensing probe (not shown) passes through the outlet 8 of the central dispensing tube 7, and a groove on the probe connects to the dispensing tube cap 9. When the probe is far enough inside the container, a hole in the side of the probe allows the liquid to flow freely from the bottle.

The label 10 of the present invention protects the tube 7 from external contaminants when the bottle cap 1 has not yet been connected to a dispensing system, such as during delivery of a bottle to a customer location. Such protection is accomplished via the affixation of the tamper-evident label 10 upon the upper face 6 of the bottle cap 1. The tamper-evident label 10 is a plastic film which is attached to the surface of the upper face 6 by a heat-sealing or heat-welding process. A band 17, about 2 millimeters in width is formed just inside the peripheral edge of the label 10. Alternative materials from which the label my be constructed include those having polyester or foil bases. The compatibility of these materials with the particular surface material of the bottle cap 1 is such that a strong and protective seal is always attained as a result of the attachment process. Attachment methods which are in accordance with the present invention include: heat sealing, sonic welding and solvent welding. An important criteria is that there be no ready way of re-attaching the label to a surface, such as the upper face 6 or the side of the bottle, such as exists when pressure sensitive adhesive labels are used.

Figure 5:
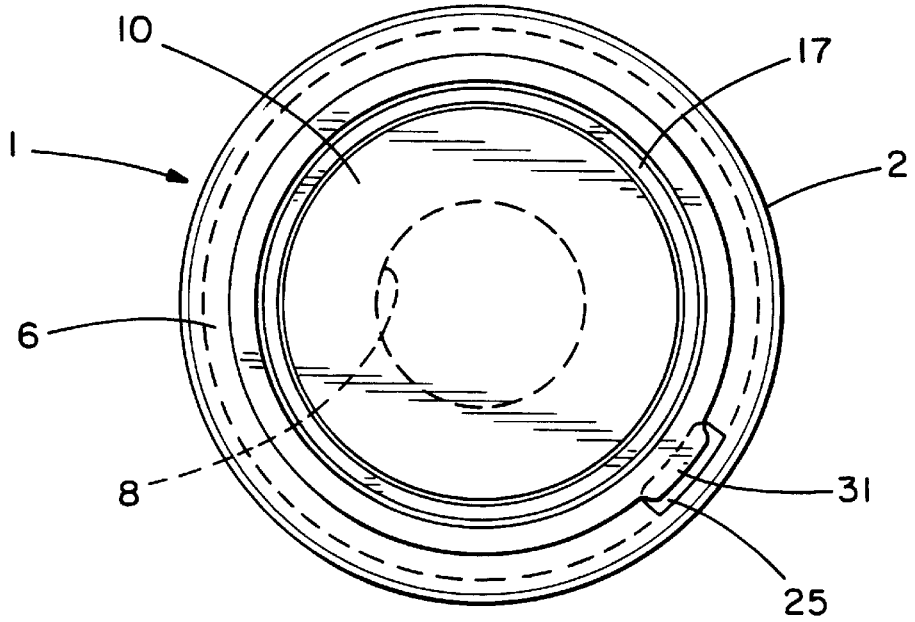
FIG. 5 is a top view of the second embodiment of the present invention.

The band 17, shown in FIG. 5, is the location where the label 10 is fused to the upper face 6 of the cap 1. However, the first embodiment of the present invention provides for a very thin peripheral edge 11 and the pull tab 31 to remain unattached to the upper face 6. This pull tab 31 serves as a grasping point by which the tamper-evident label 10 may be removed, albeit only through a very deliberate effort, by the individual who is preparing to install the bottle onto a dispensing system.

It has been found useful to mold a series of small circumferential continuous protrusions into the upper surface of the cap at the location where the band 17 is to be formed. The protrusions preferably have a sharp top edge to ensure that a concentrated or point load is achieved by the pressure of a heat welding die as such die is used to apply the label to the cap. During the heat welding process, the small protrusions (preferably three in number) are melted flat by the heat and pressure of the heat welding die. Such configuration and procedure has been found to enhance the likelihood that a good fluid-tight seal will result from the heat welding attachment of the label to the cap.

As illustrated in FIG. 2, the installer simply grasps the tamper-evident label 10 at the pull tab 31 and peels it away from the upper face 6. Accordingly, the tamper-evident label 10 goes from a sealed position, shown generally at 14, to an unsealed position, shown generally at 15. It is critical to the understanding of this invention that, due to the method of attachment for the tamper-evident label 10 whereby residual adhesive is not present, the label 10 cannot be reattached to either the upper face 6 or any other part of the bottle itself once it is removed. This inability to reattach the tamper-evident label 10 to the bottle cap 1 provides a clear indicator of whether this protective seal has been broken, and prevents the problems associated with placement of the label onto the side of the bottle.

Looking now to FIG. 3, a top elevational view of the first embodiment of the present invention is shown which specifically indicates the exact placement of the tamper-evident label 10 upon the upper face 6. The tamper-evident label 10 has a diameter 12 which is approximately equal to the diameter of the upper face 6. Once the tamper-evident label 10 is heat-sealed to the upper face 6, it clearly protects the outlet 8 of the central dispensing tube 7 from external contaminants.

Figure 4:
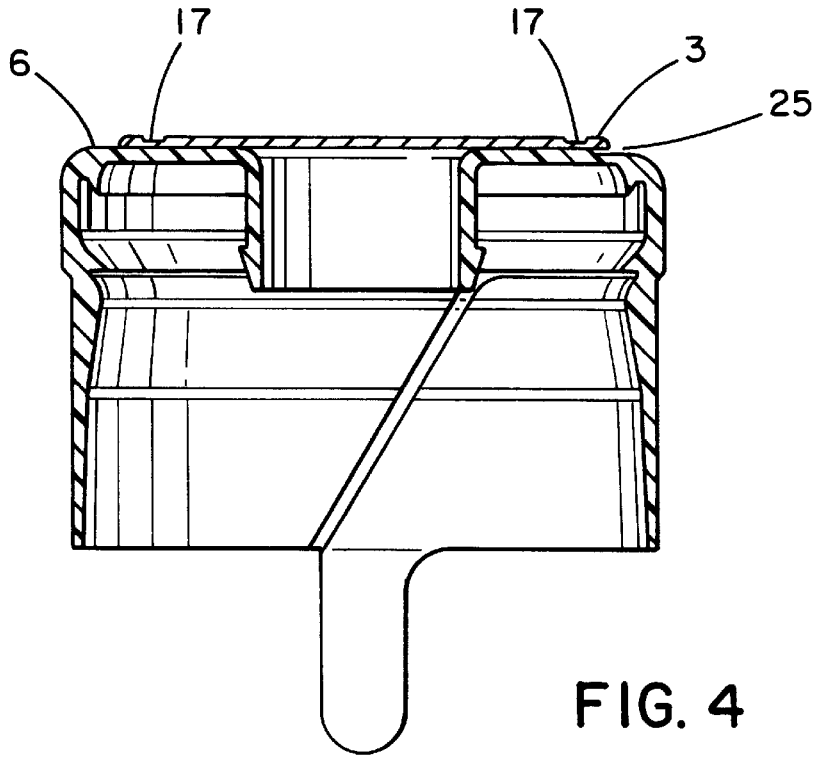
FIG. 4 is a side, cross-sectional view of a second embodiment of the present invention showing the position of the tamper-evident label in relation to the bottle cap notch.

In a second embodiment of the present invention, as shown in FIG. 4, a notch 25 in the upper face 6 readily exposes the pull tab 31. The pull tab 31 remains unattached to the upper face 6 and the pull tab 31 is positioned over the notch 25 which is formed in the upper face 6. Notch 25 has a height which is less than the thickness of the upper face 6.

Referring now to FIG. 5, a top view of the second embodiment of the present invention is shown which emphasizes the position of the tamper-evident label 10 upon the upper face 6 and the location of the band 17 formed by the heat-sealing operation. The area above the outlet 8 of the central dispensing tube 7 is spanned by the label 10. Once the tamper-evident label 10 is heat-sealed to the upper face 6, it once again clearly protects the surfaces of the central dispensing tube 7 from external contaminants.

It should be understood that the above described embodiment is intended to illustrate, rather than limit, the invention and that various modifications could be made thereto without departing from the scope of the invention as defined by the appended claims. Clearly, the outlet 8 of the improved bottle cap 1 could be protected by a tamper-evident label 10 of any number of shapes and sizes. For example, the overall diameter 12 of the tamper-evident label 10 could be only slightly larger than the diameter of the outlet 8 yet have an attached, unsealed pull tab with which to remove the tamper-evident label 10 from the upper face 6. The full diameter size, however, allows a logo or some other identifying mark to be placed on the label 10. Many bottlers desire such markings to identify themselves as the source of the contents of the container.

Similarly, it is within the contemplation of the present invention that the means used to attach the tamper-evident label 10 to the upper face 6 include such methods as sonic and solvent welding and "one-time" adhesive sealing. Indeed, within the scope of this invention are all such label attaching methods whereby the label cannot be adhesively reattached once removed.

Figure 6:
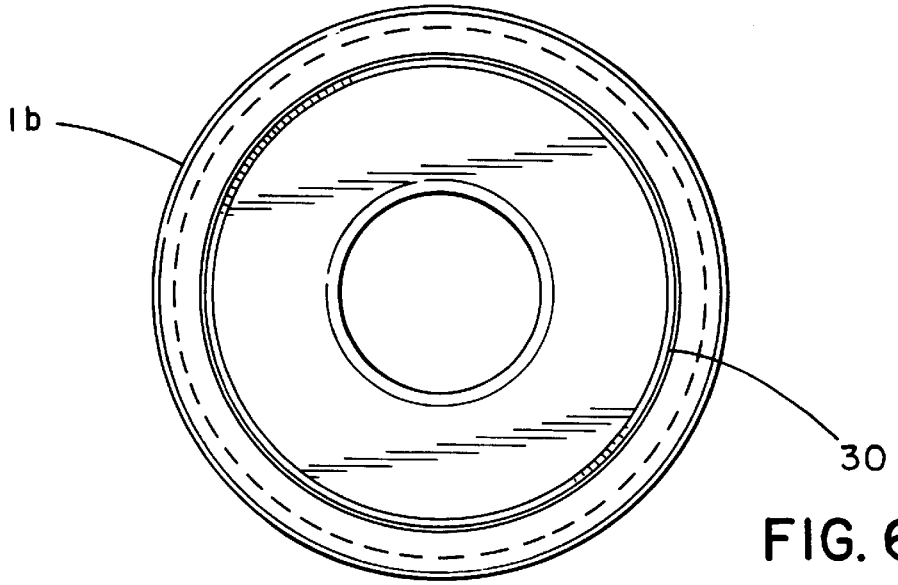
FIG. 6 is a top view of a third embodiment of the present invention showing a rib on the upper surface of the cap.
Figure 7:
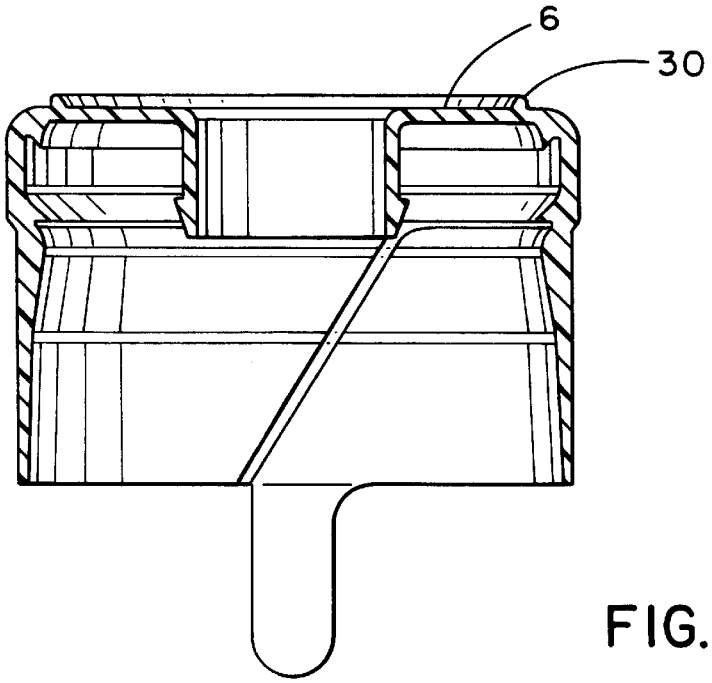
FIG. 7 is a sectional view of the cap shown in FIG. 6.
Figure 8:
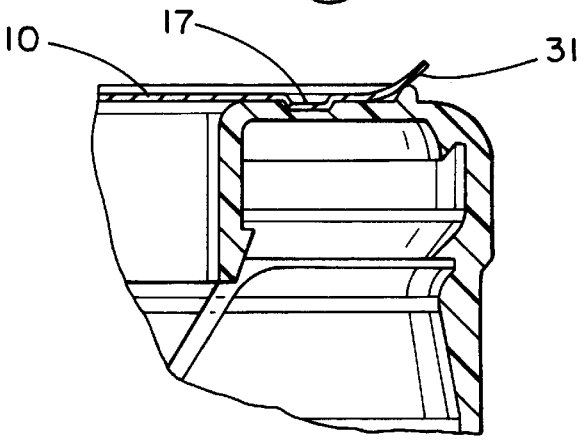
FIG. 8 is an enlarged sectional view of the cap shown in FIGS. 6 and 7 with a label attached and with an edge of the label deflected upwardly.

FIGS. 6, 7 and 8 show the third preferred embodiment of the present invention. The cap 1*b* is similar in its structure to the cap shown in FIG. 4, except for the top surface of the cap, which includes a circumferential bead 30. The bead 30 is intended to deflect an edge or the tab 31 of the tamper evident label 10 to a position in which it is readily accessible by a user. Alternatively, the area on the top of the cap within the bead 30 may filled in with plastic so that this area is at the elevation of the top of the bead 30, in which case the edge of the label will extend outwardly in a lateral direction, rather than upwardly. A similar effect may be obtained without filling the area defined by the bead with plastic by using a label which is large enough to be attached to the top of the bead 30. In this configuration, the label will be attached to the top of the bead 30, and the label will extend laterally over the space adjacent to the outside portion of the bead to enable a user to grasp the edge of the label (or a tab formed thereon).

The portion of the label which is deflected upwardly or outwardly by the bead 30 could be a tab 31 or the entire edge of the label. Alternatively, the bead 30 could be less than circumferential so that only a portion of the edge of the label is lifted or extends outwardly. By deflecting the tab 31 upward or allowing it to extend outwardly over an empty space, a user can more easily grasp the label 10 in order to remove it. The cap as shown in FIGS. 6 and 7 is in a condition wherein the label 10 has not yet been attached to the cap lb. FIG. 8 shows the cap with the label 10 affixed to the upper surface of the cap and generally within the area defined by the circumferential bead 30, except for the pull-tab 31 which extends beyond the area defined by the circumferential bead 30. As discussed above in connection with the cap shown in FIGS. 1 through 5, the label 10 is preferably attached to the top surface of the cap 1*b* by a heat-sealed connection, although other attachment techniques, such as sonic-welding or solvent-welding, may also be used. The attachment is preferably in the form of a circumferential band 17 approximately 2 millimeters in width located just inside the circumferential bead 30. The band 17 is shown in FIGS. 4, 6 and 8 as penetrating into the upper face 6 of the cap 1*b*. That penetration is a result of a heat-sealing die used to create the sealed connection between the label 10 and the cap 1*b*. The configuration of the seal may differ somewhat if other connection means, such as solvent-welding or sonic-welding, are used.

It should also be noted that the cap as shown in FIGS. 6 and 7 is without the inner cap 9 attached thereto, as shown in FIG. 2. This may be desirable, particularly if the quality of the seal at the interface between the label and the cap is strong enough, and if the advantages of the inner cap, such as are discussed in U.S. Pat. No. 5,392,939 for example, are not deemed important or necessary for a particular application or use.

Figure 9:
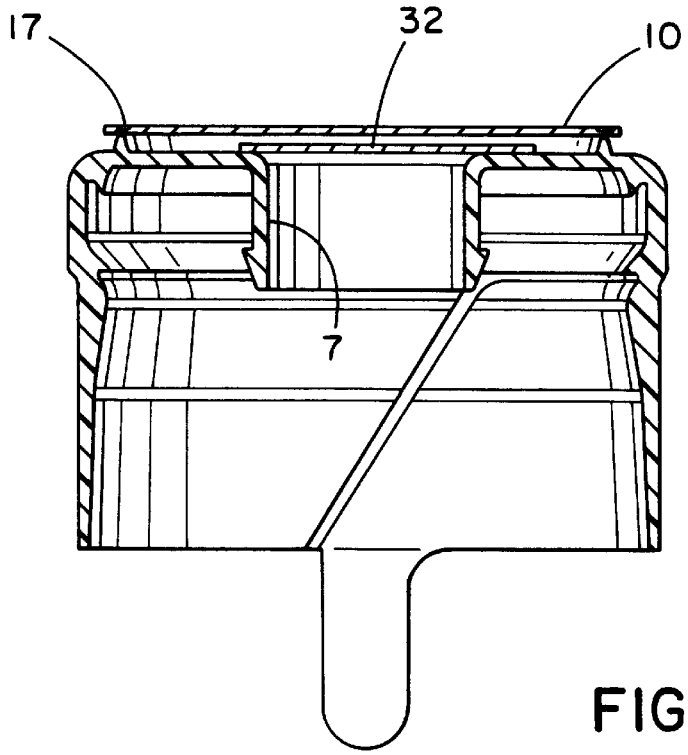
FIG. 9 is a sectional view of a further preferred embodiment of the present invention.
Figure 10:
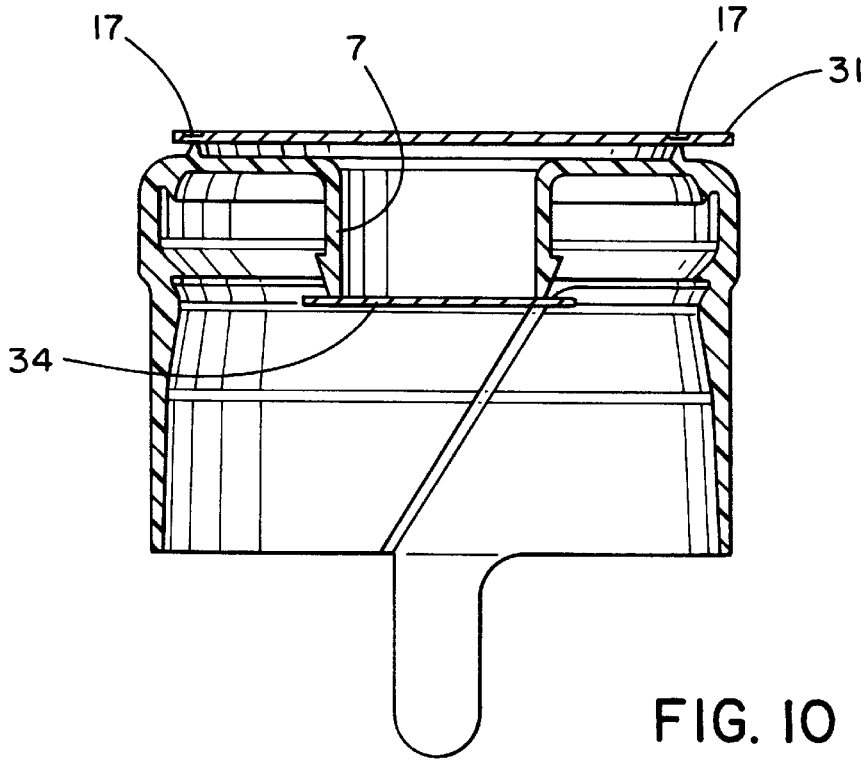
FIG. 10 is a sectional view of a further preferred embodiment of the present invention.

In two further embodiments of the present invention shown in FIGS. 9 and 10, two overlapping membranes may be applied to the cap. In the embodiment of FIG. 9, the first or outer membrane serves as a protective and informative label 10, as discussed above, while a second inner membrane 32 is attached to the top surface of the cap inside the area defined by the band 17 to serve at least the same initial purpose of the inner cap discussed above, as shown in U.S. Pat. No. 5,392,939, i.e. the purpose of allowing a container to be inverted without premature spillage of the contents before the cap is seated onto a dispensing probe. In the embodiment of FIG. 9, the band 17 is located opposite the bead 30 formed on the upper surface of the cap. The second or inner membrane 32 may be attached to any portion of the cap within the band 17 (or the bead 30), such as a location near to where the sleeve and the top of the cap merge or to the sleeve 7 itself.

In the embodiment of FIG. 10, the label 10 formed by a membrane attached by heat sealing the label 10 to the bead 30 has a tab 31 shown on the right side of FIG. 10. However, in this embodiment, the inner membrane 34 is attached to the free end of the sleeve 7 which extends into the container. The outer label 10 of the dual-membrane embodiments of FIGS. 9 and 10 is intended to protect the inner membrane from becoming dirty so that the inner membrane may be left in place and broken by a probe over which the container is lowered. The inner membrane may be formed by the sealingly attaching a separate disc to surface of the cap which surrounds the opening formed by the through-hole defined by the sleeve 7, as described hereinabove.

In connection with the printing of information on labels of the present invention, it may be useful to apply a protective transparent laminate over the top printed surface of the label. The materials of which the plastic label may be comprised include materials which will enable the label to be heat welded, but which do not hold ink, i.e. the ink may tend to smear. A transparent protective laminate adhesive may be applied to the top of the printed label. Preferably, the application of the laminate is by an adhesive and is done before the label is applied to the container. The adhesive should be one which does not allow easy separation of the laminate from the label. Otherwise, the non-reattachable nature of the label with respect to the container as discussed herein above maybe compromised.

While the present invention has been illustrated in some detail according to the preferred embodiment shown in the foregoing drawing and description, it will become apparent to those skilled in the pertinent art that variations and equivalents may be made within the spirit and scope of that which has been expressly disclosed. For example, the invention is described as being applicable to liquid containers. However, it may be advantageous to use the present invention with containers used to dispense fine or flowable solid material, such as powders or granules. Accordingly, it is intended that the scope of the invention be limited solely by the scope of the hereafter appended claims and not by any specific wording in the foregoing description.

We claim:

1. An improved bottle cap for a container, the cap having a central tube section capable of receiving a probe which is part of a dispensing system, the cap comprising:

a seal preventing external contaminants from reaching said central tube section and said container through said central tube section when said cap is applied to said container, said seal being formed by a plastic, non-metallic tamper-indicating membrane attached to a top face of said cap by a heat seal band which evidences tampering with said seal in the event of an attempt to remove said seal, said tamper-indicating membrane being free of adhesive such that it is non-reattachable to an outside surface of said container and to said top face of said cap.

2. A cap in accordance with claim 1 wherein:

said tamper-indicating membrane serves as a label for said container, said label containing printed information.

3. A cap in accordance with claim 2 wherein:

said label has a protective transparent laminate applied to prevent smearing of ink used to form said printed information.

4. A cap in accordance with claim 3 wherein:

said seal is provided by solvent welding said membrane to said top face of said cap.

5. A cap in accordance with claim 3 wherein:

said seal is provided by heat-welding said membrane to said top face of said cap.

6. A cap in accordance with claim 3 wherein:

said seal is provided by sonically welding said membrane to said top face of said cap.

7. An improved bottle cap for a container, the cap having a central tube section capable of receiving a probe which is part of a dispensing system, the cap comprising:

a seal for preventing external contaminants from reaching said central tube section and said container through said central tube section when said cap is applied to said container, said seal being formed by a plastic, non-metallic tamper-indicating membrane attached to a top face of said cap by a heat seal band which evidences tampering with said seal in the event of an attempt to remove said seal, said tamper-indicating membrane serving as a label for said container, said label containing printed information, said tamper-indicating membrane being free of adhesive such that it is non-reattachable to an outside surface of said container and to said top face of said cap.

8. A cap in accordance with claim 7 wherein:

said label has a protective transparent laminate applied to prevent smearing of ink used to form said printed information.

9. A cap in accordance with claim 8 wherein:

said seal is provided by solvent welding said membrane to said top face of said cap.

10. A cap in accordance with claim 8 wherein:

said seal is provided by heat-welding said membrane to said top face of said cap.

11. A cap in accordance with claim 8 wherein:

said seal is provided by sonically welding said membrane to said top face of said cap.

12. A cap in accordance with claim 8 wherein:

said cap includes an outer skirt and a top shaped to fit over and seal against a neck of said container.

13. A cap in accordance with claim 12 wherein:

the tamper-indicating membrane includes a pull tab and the top face of said cap includes a notch, said pull tab being positioned over said notch.

14. A cap in accordance with claim 12 wherein:

at least a portion of a peripheral edge of said label remains unattached to said cap, and said top face of the cap has a raised portion for deflecting an edge of said label upward to facilitate grasping said label.

15. A cap in accordance with claim 14 wherein:

said raised portion is a circumferential bead extending in a substantially continuous ring about said face, said bead deflecting at least a portion of said label in an upward direction away from said top face of said cap.

* * * * *